US012780505B2

(12) United States Patent
Wadsworth et al.

(10) Patent No.: US 12,780,505 B2
(45) Date of Patent: Nov. 3, 2026

(54) DETACHABLE FLIP-STRAW LID

(71) Applicant: Hydrojug, Inc., Ogden, UT (US)

(72) Inventors: Hayden Wadsworth, Ogden, UT (US); Ethan Powell, Salt Lake City, UT (US); Ryan Holmes, West Haven, UT (US); Chen Huawen, Yongkang (CN); Chen Wiexin, Yongkang (CN); Li Yuejian, Yongkang (CN); Qiu Hui, Hangzhou (CN); Wang Wei, Hangzhou (CN)

(73) Assignee: HYDROJUG, INC., Ogden, UT (US)

( * ) Notice: Subject to any disclaimer, the term of this patent is extended or adjusted under 35 U.S.C. 154(b) by 209 days.

(21) Appl. No.: 18/655,118

(22) Filed: May 3, 2024

(65) Prior Publication Data

US 2025/0223085 A1 Jul. 10, 2025

Related U.S. Application Data

(60) Provisional application No. 63/618,744, filed on Jan. 8, 2024.

(51) Int. Cl.
*B65D 47/06* (2006.01)

(52) U.S. Cl.
CPC ..... *B65D 47/066* (2013.01)

(58) Field of Classification Search
CPC . B65D 47/066; B65D 27/305; A47G 19/2266
See application file for complete search history.

(56) References Cited

U.S. PATENT DOCUMENTS 2,979,238 A * 4/1961 Bramming ..... B65D 47/305 222/536
3,653,546 A * 4/1972 Hazard ..... B65D 47/305 222/536
3,659,750 A * 5/1972 La Vange ..... B65D 47/305 222/536
3,774,822 A * 11/1973 Hazard ..... B65D 47/305 222/541.6
4,485,963 A * 12/1984 Panicci ..... A47G 19/2266 222/536

(Continued)

FOREIGN PATENT DOCUMENTS

WO WO-2020035595 A1 * 2/2020 ..... A47G 19/2266

OTHER PUBLICATIONS

Foreign Patent Document.*

*Primary Examiner* — Frederick C Nicolas
(74) *Attorney, Agent, or Firm* — Preston P. Frischknecht; Project CIP

(57) ABSTRACT

A lid for a container with a flip-straw (or spout) detachable from the lid to for user access to and cleaning of the lid. A pivotable spout is located on and detachable from the lid top. A set screw is located on and detachable from the lid bottom. The set screw is configured to engage and releasably attach the spout to the lid. Attachment may be facilitated by spout insertion into curved tracks with a terminal end in a lid recess. Another straw may be releasably attached to the lid bottom and extend downward into a drinking container. The set screw member may have a channel that passes through it, and that forms a continuous channel (together with the spout and/or other straw) when the spout is flipped up for the fluid passage from the container.

16 Claims, 6 Drawing Sheets

(56) References Cited

U.S. PATENT DOCUMENTS 5,484,089 A * 1/1996 Picerno ..... B65D 83/04 222/536
5,524,799 A * 6/1996 Skillin ..... B65D 47/305 222/536
5,873,478 A * 2/1999 Sullivan ..... A47G 19/2266 222/534
6,119,894 A * 9/2000 Hassan ..... A61J 1/03 222/536
6,267,265 B1 * 7/2001 Issa ..... B65D 83/0409 222/536
6,976,611 B2 12/2005 Lee
8,668,106 B1 * 3/2014 Joy ..... A47G 19/2266 220/717
8,672,174 B1 * 3/2014 McMullin ..... B65D 47/305 222/533
9,650,189 B1 * 5/2017 Lawson ..... B65D 47/12
9,708,107 B2 7/2017 El-Saden et al.
9,771,195 B2 9/2017 Lawson et al.
10,455,959 B2 10/2019 Coon et al.
10,988,389 B1 4/2021 Guduru
11,214,399 B1 1/2022 Hoppe et al.
11,759,034 B2 9/2023 Kalisz et al.
2012/0181303 A1 * 7/2012 Swanick ..... B65D 47/32 222/536
2012/0305559 A1 * 12/2012 Steininger ..... B65D 51/1672 220/259.2
2017/0253394 A1 9/2017 Fogarty et al.
2018/0050850 A1 * 2/2018 Murosky ..... B65D 47/2043
2020/0002063 A1 1/2020 Sorensen et al.
2021/0002041 A1 * 1/2021 Starner ..... B65D 47/066
2021/0070508 A1 * 3/2021 McNamara ..... B65D 47/065
2021/0139208 A1 5/2021 Ramseur
2022/0106084 A1 4/2022 Harris et al.
2022/0281654 A1 9/2022 Campbell et al.
2023/0284805 A1 9/2023 Davies et al.
2025/0178800 A1 * 6/2025 Gnesin ..... A47G 19/2266
2025/0340335 A1 * 11/2025 Wong ..... B65D 47/065
2025/0340337 A1 * 11/2025 Wadsworth ..... B65D 47/066

* cited by examiner

DETACHABLE FLIP-STRAW LID

RELATED APPLICATIONS

This application is the non-provisional application of, and claims priority to the provisional application U.S. Pat. App. No. 63/618,744, filed on Jan. 8, 2024, and fully incorporated herein.

BACKGROUND OF THE INVENTION

Reusable drinking containers and water bottles are increasingly popular, in part, due to a desire to be more environmentally friendly by avoiding disposable, more single use containers. Despite myriad drinking container variations in the prior art and within this market, varietal demand is seemingly unending, and users crave novel functionality and design. To illustrate, one broad category of simple reusable drinking containers are those drinking containers incorporating a lid that allows a user to pour liquid from the container in order to drink. Another category is represented by drinking containers configured to use a straw and/or spout as an integral part of the system from which a user may sip to drink. There is some crossover in these categories. For example, drinking systems of the first category may be retrofitted to the second category through aftermarket and/or straw accessory purchases. Other crossover solutions are operationally and aesthetically complicated and reliability-disadvantaged by mechanisms like internal valves and valve selectors and multiple drinking apertures and/or locations.

In any event, one consequence of the above is that containers and container lids that have flip-spouts and/or straws connectable to in-container straws (alternatively referred to herein as "flip-spouts" and "flip-straws") are very popular for different types of drinking containers. One drawback of such flip-spout lids is the difficulty of cleaning them. Specifically, flip-spouts are typically nestable within recesses of top lid portions. Moreover, bottom lid portions—where the in-container straw connects—have their own recesses and difficult-to-reach surfaces. These recesses and surfaces tend to accumulate dirt, residue, moisture, and the like. This is not only aesthetically undesirable, but can also result in harm to a user via exposure to mold, bacteria, viruses and other pathogens. Current flip-spout lid design and configuration is meant to retain the flip-spout securely within the top lid portions and not to allow a user to remove the flip-spout for access to problem cleaning areas. What is needed is a solution that achieves the function of retaining a flip-spout securely to a lid, while also allowing a user to detach the flip-spout to easily access lid recesses and surfaces for proper cleaning.

SUMMARY OF THE INVENTION

In accordance with the above, a detachable flip-straw lid is provided. The container lid includes a flip-straw (or spout) that is detachable from the lid to facilitate user access to and cleaning of lid components. The spout is pivotable and located on and detachable from the lid top. A set screw member is located on and detachable from the lid bottom. The set screw member is configured to engage and releasably attach the spout member to the lid. In some embodiments, attachment is facilitated by insertion of a spout end into curved tracks with a terminal end in a lid recess. Another straw may be releasably attached to the bottom of the lid and extend downward into a drinking container.

Depending on the embodiment, the set screw member may have a channel that passes through it, and that forms a continuous channel (together with the pivotable spout member and/or other straw) when the spout is flipped up for the passage of fluid from a container.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

Figure 1:
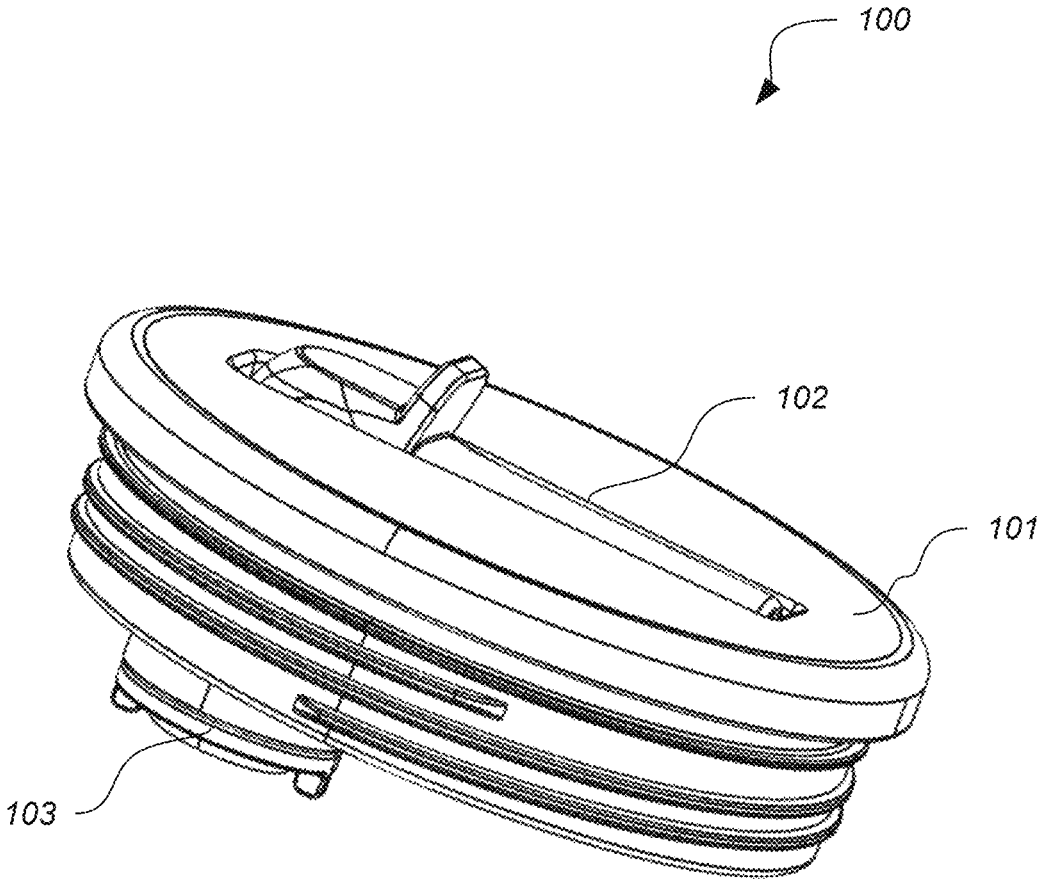
FIG. 1 is a perspective view of one embodiment of a detachable flip-spout lid.

The present invention in its various embodiments, some of which are depicted in the figures herein, is a detachable flip-spout lid 100. In general, the detachable flip-spout lid 100, may be comprised of a body or base 101 with a flip-spout 102 at the top of the base 101 and a set screw member 103 at the bottom of the base 101 that is configured to releasably retain the flip-spout 102 at, on, or within the base 101.

More specifically, base 101 may have a generally planar top with an elongate recess 201 configured to nest the flip-spout 102. In the illustrated embodiment, the recess is wider at one end and narrows toward the opposite end. Elongate recess 201 may form a primary recess and have a secondary (e.g., rounded) and/or sub-recess 301 shaped to a corresponding shape 208 on an end B of the flip-spout 102. Within secondary recess 301 may be a first channel 302 that passes through the base 101 and is configured to convey liquids from an attached container (like, e.g., a water bottle or tumbler) through the base 101 and into the flip-spout 102 for user drinking. A second channel 303 may be located adjacent to the first channel 302 and configured for venting to facilitate conveyance of liquids from a container to a user for drinking.

Figure 2:
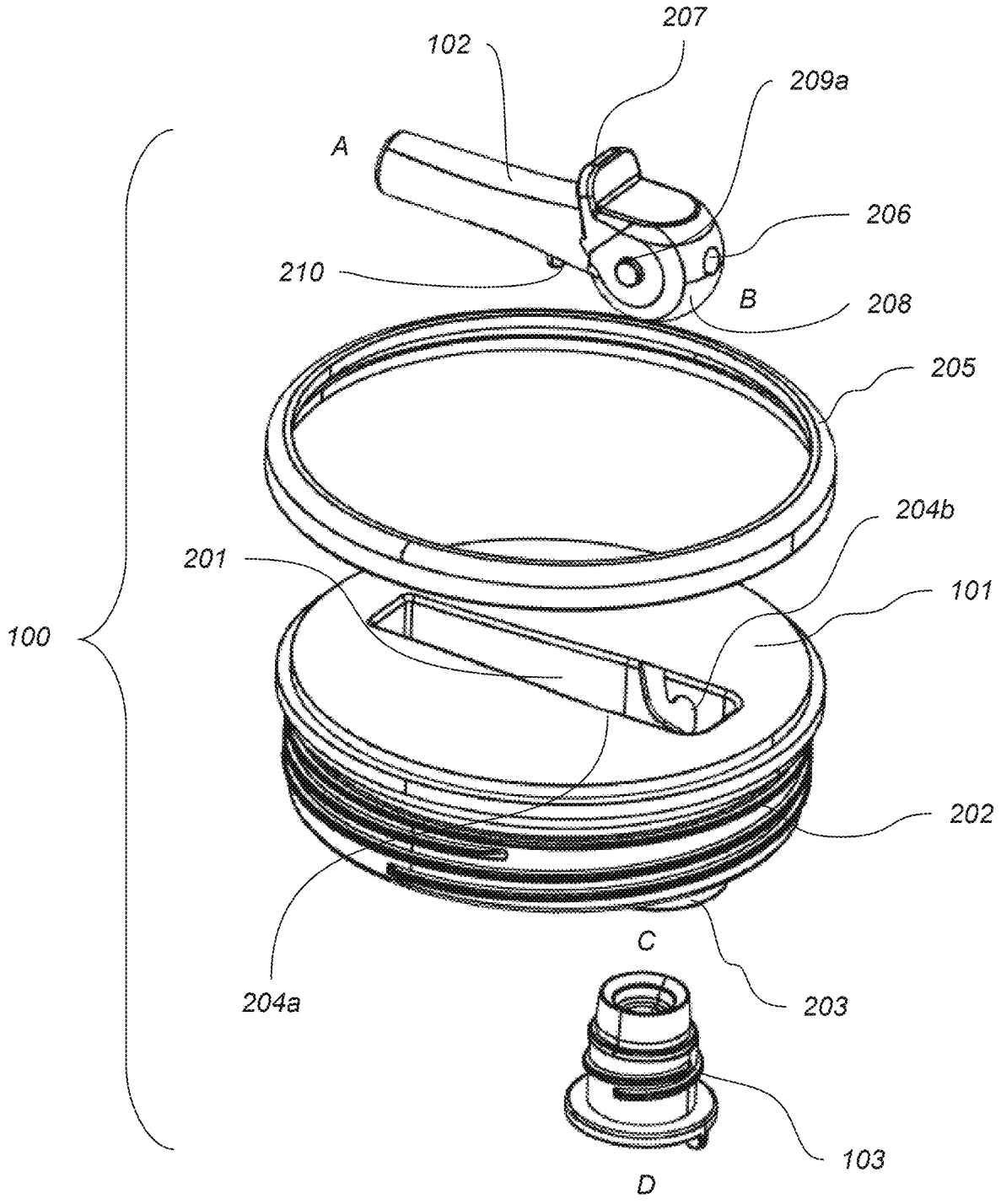
FIG. 2 is an exploded perspective view of one embodiment of a detachable flip-spout lid.
Figure 3:
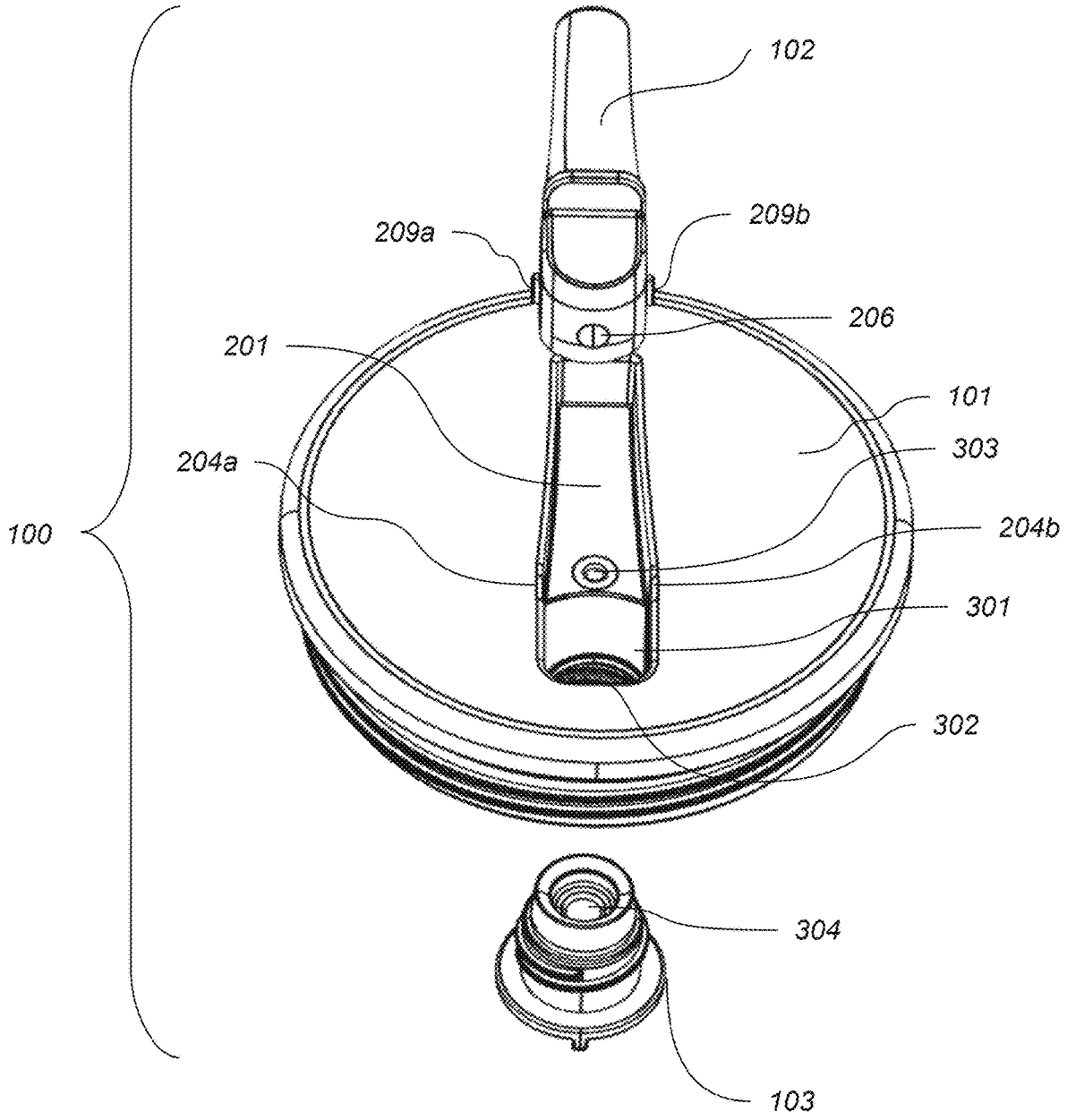
FIG. 3 is a partially exploded perspective view of one embodiment of a detachable flip-spout lid.
Figure 4:
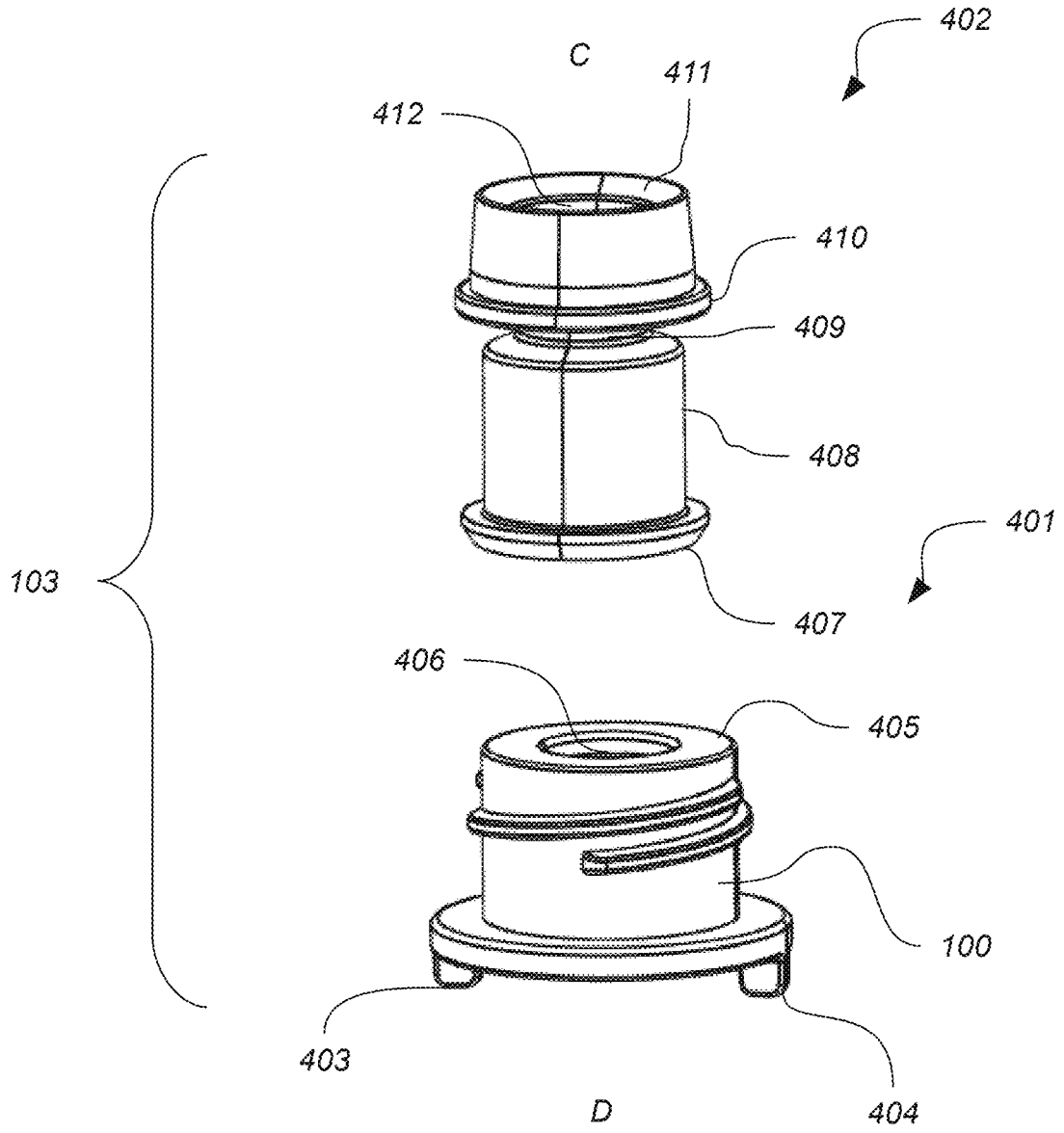
FIG. 4 is an exploded perspective view of a set screw member of one embodiment of a detachable flip-spout lid.
Figure 5:
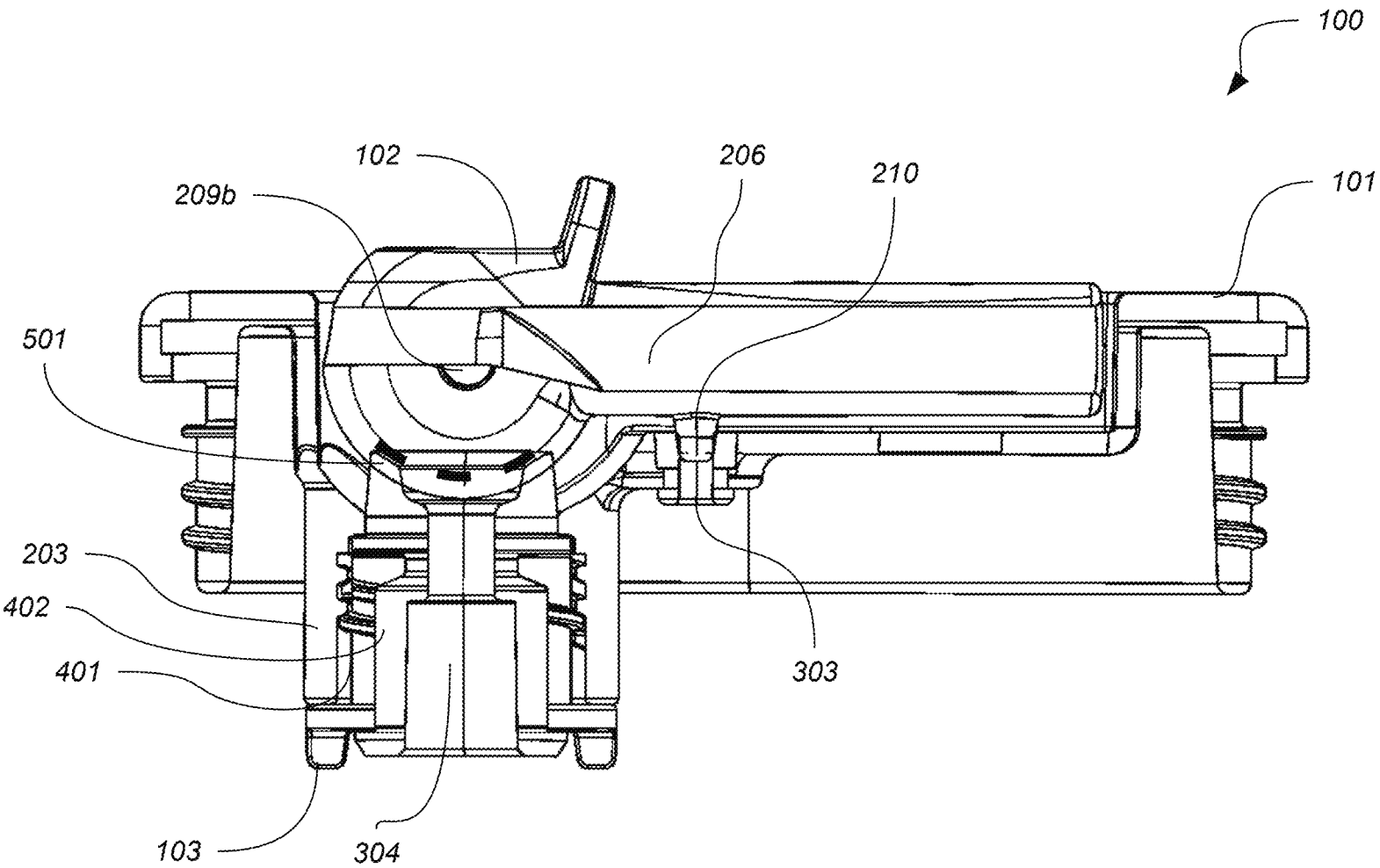
FIG. 5 is a cross-section view of a one embodiment of a detachable flip-spout lid.
Figure 7:
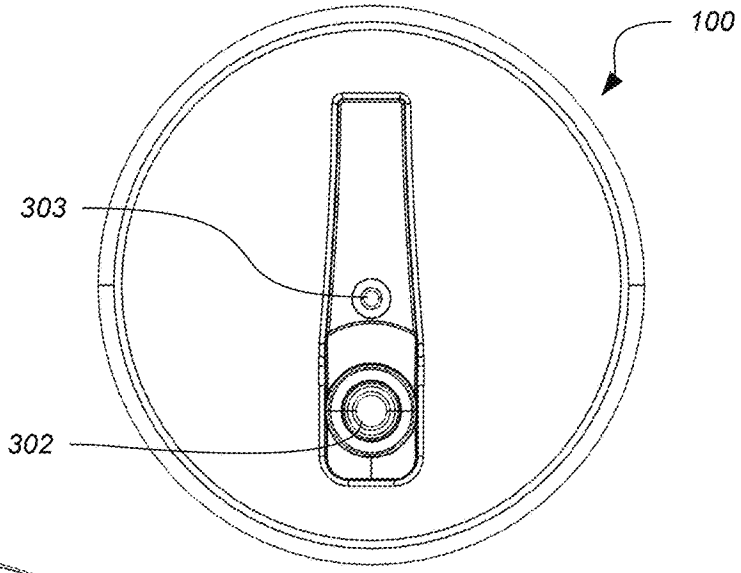
FIG. 7 is a top view of one embodiment of a detachable flip-spout lid without a flip-spout/spout portion.
Figure 6:
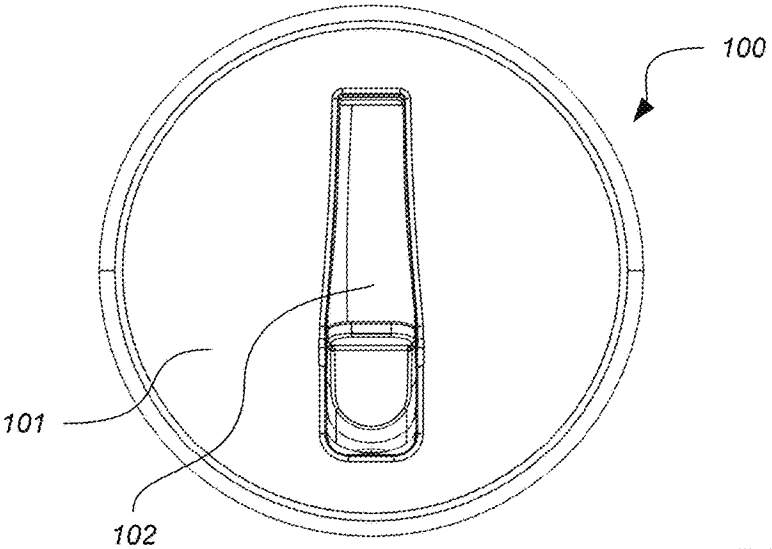
FIG. 6 is a top view of one embodiment of a detachable flip-spout lid.
Figure 8:
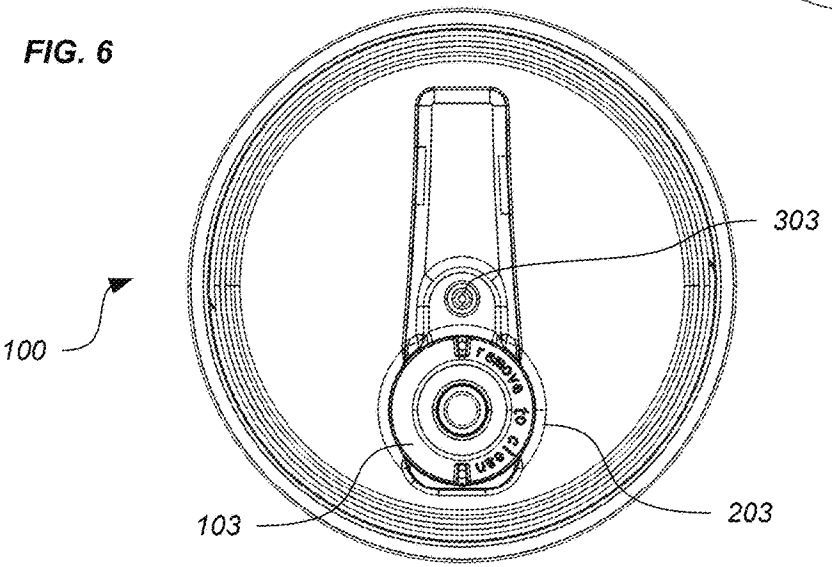
FIG. 8 is a bottom view of one embodiment of a detachable flip-spout lid.

Elongate recess 201 may also have additional sub-recesses 204*a*, 204*b* comprising opposing flip-spout retention means and/or tracks for receiving and/or retaining corresponding flip-spout protrusions 209*a*, 209*b* as described in more detail below. Flip-spout retention sub-recesses and/or tracks 204*a*, 204*b* may be curved (such as, for example, generally comma-, J-, U, V, or C-shaped) and have a terminal end, including a terminal end that has an upward portion. As shown just to the left of 204*b* in FIG. 2, tracks may have an overhanging protrusion adjacent the terminal end and/or upward portion.

Base 101 may have a threaded portion 202 configured to attach the lid 100 to a container (not shown). Base 101 may also have a bottom with an integrally formed aperture and/or downwardly oriented housing 203 into which the set screw member 103 is insertable and that is configured to releasably retain the set screw member 103. Base 101 may also have one or more rubberized detachable or non-detachable O-ring portions 205 or other features for improving grip for a user.

Flip-spout 102 may have a first end A and a second end B with a channel 206 providing an interior passage in-between and therethrough. The first end A is configured as a location for a user to apply his or her mouth to drink through or sip from the spout 102. A second end B is configured for spout retention and flip functions and may include supporting structures such as a finger tab 207 and/or rounded portion 208 configured to movably position within a rounded base sub-recess 301 and/or elongate recess 201. Flip-spout 102 may also have a first protrusion 210 on the bottom configured to plug the second channel and/or vent aperture 303. Flip-spout 102 may also have second and third protrusions 209*a*, 209*b* on opposite sides of the flip-spout that are configured to form rails that slide into the respective tracks 204*a*, 204*b* of the base 101, thus releasably retaining the flip-spout 102 in the elongate recess 201 and base 101. For clarity, in the illustrated embodiment, second and third protrusions 209*a*, 209*b* abut the terminal ends of the tracks 204*a*, 204*b*, behind (i.e., to the right of in FIG. 2) the adjacent track protrusions, when the flip-spout is attached 102 to the lid.

Set screw member 103 may have a first end C and a second end D with a generally cylindrical body portion having a channel 304 in between. Set screw member 103 has means for attachment to integrally formed aperture and/or downwardly oriented housing 203 such that set screw member 103 may be advanced in a direction extending towards the top of the base 101 (from the bottom thereof) and be releasably retained within the aperture/housing 203. In the illustrated embodiment, this is accomplished through threading. However, any number of locking and/or fastening structures and/or mechanisms may be used to achieve the same or similar function without departing from the purposes or scope of the invention. The term "set screw member" is not restricted to conventional and/or traditional definitions of the words "set screw" or to structures traditionally associated with that term; rather, the term is meant to indicate an umbrella category for any analogous structures (e.g. locks, plugs, etc.) that achieve similar functionality (e.g., interference fit, mechanical/releasable lock, etc.) to that of a traditional set screw, or structures that achieve function similar to the set screw member set forth herein.

The first end C of set screw member 103 is configured such that, when advanced into the aperture/housing 203 at the bottom of the base 101, it forms a gasket 501 that exerts upward pressure on an end of the flip-spout 102 to securely retain it within the base 101, and specifically, to provide upward force to the protrusions and/or rails 209*a*, 209*b* within the flip-spout retention sub-recesses and/or tracks 204*a*, 204*b*, the adjacent track protrusions acting as barriers to the flip-spout protrusions. With set screw member 103 advanced within the aperture/housing 203, the flip-spout 102 is securely retained in the base 101 (within, e.g., the upward terminal end of the tracks), yet still pivotable by a user within the base 101 such that it may be flipped up so that the flip-spout channel 206 aligns with the set screw member channel 501 to allow liquid to pass from the container, using, for example, a straw that is generally below the set screw member 103 and attached to the bottom thereof, and through the set screw member 103 and flip-spout 102 to a user's mouth. With set screw member 103 disengaged (e.g., unscrewed), the gasket 501 no longer exerts upward pressure on the flip-spout 102 and the protrusions and/or rails 209*a*, 209*b* may be slid off of the retention sub-recesses and/or tracks 204*a*, 204*b* (forward, in the direction of the front spout opening) so that the flip-spout 102 can be detached from the base 101 for easy cleaning (e.g., dishwashing) of spout and lid structures or for other purposes.

Set screw member 103 may be integrally formed or formed of various sub-components that combine. For example, in the illustrated embodiment, set screw member 103 includes a rigid (e.g., plastomeric, metal, etc.) member 401 and a semi-rigid and/or flexible (e.g., silicone, rubber, etc.) member 402, a portion of which fits within and/or is releasably retained by the rigid member 401.

So configured, the spout and related components are detachable from the lid to facilitate easier cleaning by a user (including separation of parts for dishwashing) than would otherwise be obtained by attempts to clean hard-to-reach recesses and parts of similarly configured lids without such detachable parts.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A container lid comprising:

a pivotable spout member located on and detachable from a top of the lid, the pivotable spout member having a first end and a second end opposite the first end, the second end having opposing protrusions;

a set screw member located on and detachable from a bottom of the lid and configured to engage and releasably retain an end of the pivotable spout member within the lid by applying upward force; and a body into which the pivotable spout member and set screw member insert.

2. The container lid of claim 1, the body having opposing tracks configured to receive and releasably retain the protrusions.

3. The container lid of claim 2, wherein each of the tracks is curved.

4. The container lid of claim 2, wherein each of the tracks is one of: comma shaped, J-shaped, U-shaped, V-shaped, and C-shaped.

5. The container lid of claim 2, wherein each of the tracks has a terminal end and an overhanging protrusion adjacent the terminal end.

6. The container lid of claim 1, wherein the set screw member has a channel configured to allow fluids from a container attached to the lid to pass through the set screw member to the pivotable spout member.

7. The container lid of claim 6, wherein the channel is configured to connect to a detachable straw member that extends downward from the container lid.

8. A container lid comprising:

a pivotable spout member located on and detachable from a top of the lid, the pivotable spout member having a first end and a second end opposite the first end, the second end having opposing protrusions;

a set screw member located on and detachable from a bottom of the lid and configured to engage and releasably retain an end of the pivotable spout member within the lid by applying upward force;

a body into which the pivotable spout member and set screw member insert, the body having opposing recessed tracks configured to receive and releasably retain the protrusions.

9. The container lid of claim 8, wherein each of the tracks is curved and configured to convey the pivotable spout member so that it horizontally traverses a portion of the lid body.

10. The container lid of claim 8, wherein each of the tracks is one of: comma shaped, J-shaped, U-shaped, V-shaped, and C-shaped.

11. The container lid of claim 9, wherein each of the tracks has a terminal end and an overhanging protrusion adjacent the terminal end.

12. The container lid of claim 8, wherein the set screw member has a channel configured to allow fluids from a container attached to lid to pass through the set screw member to the pivotable spout member.

13. The container lid of claim 12, wherein the channel is configured to connect to a detachable straw member that extends downward from the container lid.

14. A container lid comprising:

a pivotable spout member located on and detachable from a top of the lid, the pivotable spout member having a first end and a second end opposite the first end, the second end having opposing protrusions;

a set screw member located on and detachable from a bottom of the lid and configured to engage and releasably retain an end of the pivotable spout member within the lid by applying upward force, the set screw member having a channel configured to allow fluids from a container attached to the lid to pass through the set screw member to the pivotable spout member;

a body into which the pivotable spout member and set screw member insert, the body having opposing recessed and curved tracks configured to receive and releasably retain the protrusions, each of the tracks formed by facing sides that are at least partially curved and having a terminal end and an overhanging protrusion adjacent the terminal end.

15. The container lid of claim 14, wherein each of the tracks is one of: comma shaped, J-shaped, U-shaped, V-shaped, and C-shaped.

16. The container lid of claim 14, the second end being at least partially rounded.

* * * * *